US005799807A

United States Patent [19]

Hamme

[11] Patent Number: 5,799,807

[45] Date of Patent: Sep. 1, 1998

[54] MOBILE CRANE

[75] Inventor: Ulrich Hamme, Ehingen, Germany

[73] Assignee: Liebherr-Werk Ehingen GmbH, Ehingen/Donau, Germany

[21] Appl. No.: 763,751

[22] Filed: Dec. 11, 1996

[30] Foreign Application Priority Data

Dec. 12, 1995 [DE] Germany ..... 195 46 388.9
Feb. 19, 1996 [DE] Germany ..... 196 06 109.1

[51] Int. Cl.[6] ..... B66C 23/42

[52] U.S. Cl. ..... 212/299; 212/232; 212/298

[58] Field of Search ..... 212/225, 227, 212/230, 231, 296, 297, 298, 299, 300, 348, 349

[56] References Cited

U.S. PATENT DOCUMENTS 4,394,914 7/1983 Privat ..... 212/300

FOREIGN PATENT DOCUMENTS 334187 9/1989 European Pat. Off. ..... 212/231
394066 4/1924 Germany ..... 212/230
3307892 9/1984 Germany ..... 212/300
1147678 3/1985 U.S.S.R. ..... 212/300

*Primary Examiner*—Thomas J. Brahan
*Attorney, Agent, or Firm*—Dilworth & Barrese

[57] ABSTRACT

The present invention relates to a mobile crane with a telescoping jib hinged to its superstructure which jib can be luffed by a luffing ram which is hinged to the telescoping jib and the superstructure, with a guy pole hinged on the rear side of the telescoping jib in the upper area of its hinge section which guy pole can be raised by a hydraulic ram, and with a winch by which a guy rope extending from the tip of the guy pole to the top part of the inner telescope section or a truss of an upper telescope section can be tautened. In accordance with the invention the guy pole is guyed over the superstructure, the base or the hinge axle of the hinge section or the lower area of the hinge section by a rope or by a rod of a predetermined length and the winch is positioned in the area of the tip of the guy pole.

20 Claims, 1 Drawing Sheet

MOBILE CRANE

BACKGROUND OF THE INVENTION

The present invention relates to a mobile crane with a telescoping jib hinged to its superstructure which jib can be luffed by means of a luffing ram which is hinged to the telescoping jib and the superstructure, with a guy pole hinged on the rear side of the telescoping jib in the upper area of its hinge section which guy pole can be raised by means of a unit consisting of pressure means, piston and cylinder, and with a winch by means of which a guy rope extending from the tip of the guy pole to the top part or truss of an inner telescope section can be tautened.

A mobile crane with a guyed telescoping jib is known from DE-31 13 763 C2 with the winch which tautens the guy rope and the fixed point of the guy rope being positioned on opposite sides of the telescoping jib approximately in the swivel axis connecting the guy pole and the hinge section. The guy pole is guyed over the telescoping jib by ropes which extend from the far ends of the guy pole to the base of the hinge section of the telescoping jib. The guying of this known telescoping jib is relatively complicated as it is not only performed by the guy rope which can be tautened by the winch but in addition also by the permanently installed ropes which cannot be varied in length and which can be braced by means of hydraulic rams. In addition, with this known mobile crane the guy rope is automatically regulated by the winch in dependence on the length of the jib and/or on the load and/or the jib angle which all require additional effort.

A mobile crane known from EP-0 334 178 A1 of the above-mentioned type comprises a more simply guyed telescoping jib to the extent that the guy pole is held by a hydraulic ram which in addition to its function as a holding ram also serves as a raising ram. With this known mobile crane the winch and the fixed point of the guy rope are positioned on opposite sides of the telescoping jib in the area of its swivel axis and the guying of the telescoping jib is realized by means of the winch alone. This known mobile crane is also still relatively complicated due to the guiding of the guy rope.

SUMMARY OF THE INVENTION

It is therefore the object of the invention to provide a mobile crane of the type described above with a more simply guyed telescoping jib.

This object is solved in accordance with the invention by a mobile crane of the type described above with the guy pole being guyed over the superstructure or the base or the hinge axle of the guy section by a rope or rod of predetermined length and with the winch being positioned at the tip of the guy pole.

With the mobile crane in accordance with the invention the construction of the unit which raises the guy pole and which consists of pressure means, piston and cylinder need not be very strong as it does not have any bearing or supporting function. Instead of a unit consisting of pressure means, piston and cylinder another device for raising the guy pole could be also be provided. After the raising of the guy pole the guy pole together with the rope or rod and the lower part of the hinge section forms a substantially rigid retaining triangle for the guy rope. The winch tautening the guy rope is positioned at the tip of the guy pole so that a guying of the telescoping jib can be performed directly without guiding the guy rope around pulleys.

A further embodiment of the present invention provides that the winch is provided with a ratchet and pawl mechanism which maintains the applied prestressing force of the guy rope. To be able to release the winch again automatically, the ratchet and pawl mechanism can be provided with a releasing device that can be activated automatically.

A further embodiment of the present invention provides that the guy rope is guyed with constant force by the winch according to the angle of the hinge section and the extension state of the telescopes. This type of guying can be realized in a simple and reliable manner.

When the mobile crane is put into operating status it is appropriately assumed that each luffing angle has a corresponding specific extension state of the telescopes to ensure the optimum prestressing of the guy rope. The angles of the hinge section corresponding to each extension length are appropriately filed in a list (bit-map) so that they can be read by the electronic control unit during the automatic control of the operating status.

Furthermore, each extension state and consequently each luffing angle of the hinge section corresponds to a specific prestressing force of the guy rope. This prestressing force is of such a magnitude that the guy rope sags by the required extent during the unloaded state of the crane. Only when the crane is loaded and the telescoping jib bows under the weight is this sag lost due to a corresponding stress of the guy rope, it being ensured that the jib does not bow by more than its permitted extent.

BRIEF DESCRIPTION OF THE DRAWINGS

One embodiment of the present invention will be described in the following in more detail by means of the drawing in which.

DESCRIPTION OF THE PREFERRED EMBODIMENTS

Figure 1:
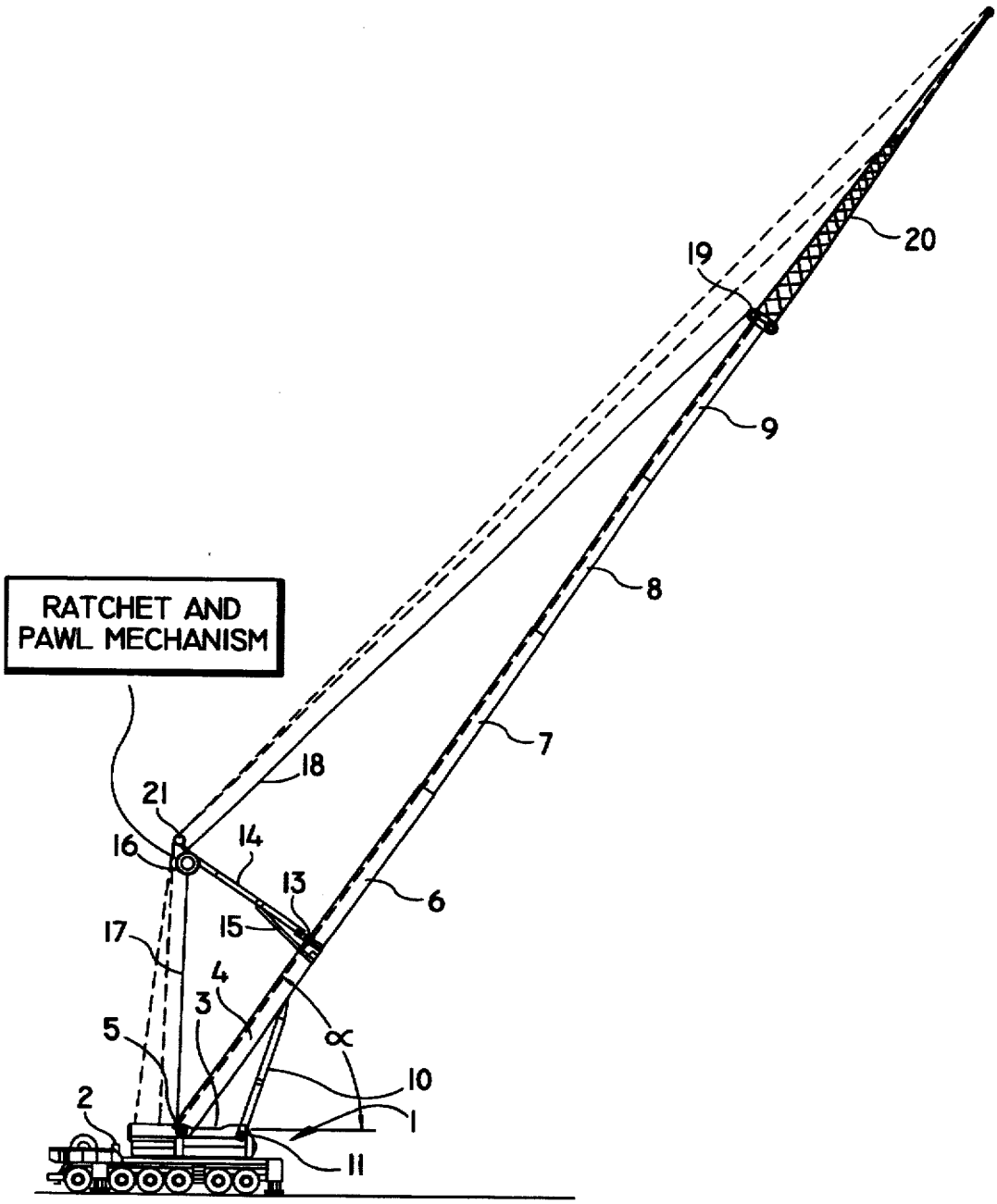
FIG. 1 illustrates a side view of a mobile crane in accordance with the invention is shown.

On the carrier 2 of a mobile crane 1 provided in the usual manner with stabilizing sliding beams a superstructure 3 is pivoted in the usual manner on which the hinge section 4 of the telescoping jib is swivel mounted round an axis 5. The telescopes 6 to 9 of the telescoping jib which enclose each other can be telescoped out of the hinge section 4 in the usual manner.

The hinge section 4 can be luffed over the superstructure 3 by means of the hydraulic luffing ram 10 whose ram is swivel hinged on the superstructure round the axis 11 and whose piston rod is hinged approximately in the middle area of the hinge section 4.

The guy pole 14 is swivel hinged round the axis 13 to the far end area of the hinge section 4. When folded together the guy pole 14 is folded against the hinge section 4. To raise the guy pole 14 a pressure-means-piston-cylinder unit 15 is provided which is hinged with one end to the guy pole 14 and with its other end to the hinge section 4 in the manner shown.

A winch 16 is rigidly positioned on the far end of the guy pole 14. The far end of the guy pole 14 is guyed over the superstructure 3 by means of a rope or a foldable rod 17 with the fixed point of the rope or guy rod 17 being located in the swivel axis 5 or the lower part of the telescoping jib hinge section 4 of the telescoping jib. A guy rope 18 runs from the winch 16 to a pulley 19 mounted on the top part of the furthest telescope section or to one of the trusses of the upper telescope sections. From the pulley the guy rope is led to the tip of the guy pole 14 where the fixed point of the guy winch 16 is located on the opposite side. The resultant of the guy rope 18 intersects almost at one point the resultant of the fixed guying 17.

In the embodiment shown the outer telescope section 9 additionally comprises a foldable tip 20 through which a larger jib length can be achieved.

At the far end of the guy pole 14 pulleys 21 are supported, around which the hoist rope runs in the usual manner. The hoist rope reeving and the hoist rope winch is of the usual design and will therefore not be described in more detail.

Each extension length of the telescoping jib corresponds to a certain luffing angle α at which the guy rope will be prestressed with a predetermined force when the crane is not under load.

The guy rope 18 is tautened around the winch 16 in accordance with the extension length or the luffing angle α, i.e. the guy rope 14 is prestressed with a constant force by the winch 16 according to the angle α of the hinge section 4 and the extension state of the telescopes 6–9 while the crane 1 is not under load. The guying of the guy rope will be performed for the relevant extension state with a constant force which is so high that the guy rope 18 sags by a certain amount when the jib is in an unloaded state. This sagging will only be lost when the jib is loaded by a load that is to be lifted. Here, the sag is such that the jib cannot sag beyond a permissible measure.

The winch 16 is positioned in the upper area of the guy pole 14 in such a way that no additional pulley is required for the guy rope. This means that the guy rope runs from its fixed point in the area of the guy winch over the outer pulley and from there directly to the drum of the guy winch.

I claim:

1. A mobile crane comprising a telescoping jib hinged to a superstructure thereof, which jib is structured and arranged to be luffed by means of a luffing ram which is hinged to the telescoping jib and the superstructure, a guy pole hinged on a rear side of the telescoping jib in an upper area of a hinge section thereof, which guy pole is structured and arranged to be raised by means of a hydraulic ram, and a winch about which a guy rope is wound, by means of which the guy rope extending from a tip of a guy pole to a top part of an inner telescope section or a truss of an upper telescope section is arranged to be tautened, wherein the guy pole is guyed over the superstructure, a base or hinge axle of the hinge section or a lower area of the hinge section, by a rope or rod of a predetermined length and the winch is positioned in the area of the tip of the guide pole.

2. A mobile crane in accordance with claim 1, wherein the winch is provided with a ratchet and pawl mechanism which prevents the unwinding of the winch when the guy rope is under load.

3. A mobile crane in accordance with claim 2, wherein the guy rope is prestressed with a constant force by the winch according to the angle of the hinge section and the extension of state of the telescopes while the crane is not under load.

4. A mobile crane in accordance with claim 3, wherein for guying, the guy rope is directly taken up by the a drum of the winch.

5. A mobile crane in accordance with claim 2, wherein for guying, the guy rope is directly taken up by a drum of the winch.

6. A mobile crane in accordance with claim 1, wherein the guy rope is prestressed with a constant force by the winch according to the angle of the hinge section and the extension state of the telescopes while the crane is not under load.

7. A mobile crane in accordance with claim 6, wherein for guying, the guy rope is directly taken up by a drum of the winch.

8. A mobile crane in accordance with claim 1, wherein for guying, the guy rope is directly taken up by a drum of the winch.

9. A mobile crane in accordance with claim 1, wherein the hinge section is situated in a lower area of the telescoping jib and couples the telescoping jib to the underlying superstructure.

10. A mobile crane in accordance with claim 9, comprising an axis situated on an upper end of the hinge section and on which the guy pole is swivel hinged.

11. A mobile crane in accordance with claim 1, wherein means for raising the guy pole includes a pressure-means-piston-cylinder unit which is hinged with one end to the guy pole and with the other end to the hinge section.

12. A mobile crane in accordance with claim 1, wherein the winch tautening the guy rope is positioned at the tip of the guy pole in a manner such that guying of the telescoping jib can be performed directly without guiding the guy rope around pulleys.

13. A mobile crane in accordance with claim 1, additionally comprising a pulley mounted on the top part of the inner telescope section or to one of the trusses of upper telescope sections, and over which the guy rope is lead to the tip of the guy pole where a fixed point of the guy winch is located on the opposite side thereof.

14. A mobile crane in accordance with claim 13, wherein the guy rope is lead from the pulley to the tip of the guy pole, with a resultant of the guy rope intersecting, almost at one point, a resultant of the rope or rod of predetermined length.

15. A mobile crane in accordance with claim 1, wherein the winch is located on an opposite side of the guy pole from the upper telescope section.

16. A mobile crane in accordance with claim 1, wherein the upper outer telescope section of the telescoping jib additionally comprises a foldable tip.

17. A mobile crane in accordance with claim 1, additionally comprising pulleys supported at a far end of the guy pole from the hinge section and around which a hoist rope runs.

18. A mobile crane in accordance with claim 1, wherein the rope or rod of predetermined length is coupled to a swivel axis of the hinge section upon the superstructure, or the lower part of the hinge section, and to the tip of the guy pole from the hinge section.

19. A mobile crane in accordance with claim 18 wherein, after raising, the guy pole together with the rope or rod and lower part of the hinge section form a substantially rigid retaining triangle for the guy rope.

20. A mobile crane in accordance with claim 1, wherein, after raising, the guy pole together with the rope or rod and lower part of the hinge section form a substantially rigid retaining triangle for the guy rope.

* * * * *